US008688359B2

(12) United States Patent
Kuniyoshi et al.

(10) Patent No.: US 8,688,359 B2
(45) Date of Patent: Apr. 1, 2014

(54) IDLE STOP CONTROL METHOD AND CONTROL DEVICE

(75) Inventors: Hiroyasu Kuniyoshi, Hitachinaka (JP); Akira Nishioka, Hitachinaka (JP); Ryuu Kai, Hitachinaka (JP); Kenichi Machida, Isesaki (JP); Yoshiaki Nagasawa, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 331 days.

(21) Appl. No.: 13/196,099

(22) Filed: Aug. 2, 2011

(65) Prior Publication Data

US 2012/0035827 A1 Feb. 9, 2012

(30) Foreign Application Priority Data

Aug. 4, 2010 (JP) ..... 2010-174989

(51) Int. Cl.
*F02N 15/00* (2006.01)

(52) U.S. Cl.
USPC ..... 701/112; 701/113; 123/179.25

(58) Field of Classification Search
USPC ..... 123/179.3, 179.4, 179.25, 179.28; 701/110, 112, 113; 73/114.25, 114.58, 73/114.59
See application file for complete search history.

(56) References Cited

U.S. PATENT DOCUMENTS

| | | | | |
|---|---|---|---|---|
| 2010/0282199 | A1 | 11/2010 | Heyers et al. | |
| 2011/0137544 | A1* | 6/2011 | Kawazu et al. | 701/113 |
| 2011/0270512 | A1* | 11/2011 | Hayashi et al. | 701/112 |
| 2012/0318227 | A1* | 12/2012 | Hashimoto et al. | 123/179.3 |
| 2013/0054185 | A1* | 2/2013 | Cwik et al. | 702/145 |

FOREIGN PATENT DOCUMENTS

| | | | | |
|---|---|---|---|---|
| CN | 101432519 | A | 5/2009 | |
| EP | 2 211 051 | A1 | 7/2010 | |
| JP | 4214401 | B2 | 11/2008 | |
| JP | 2010-229882 | A | 10/2010 | |
| JP | 2012-36747 | * | 2/2012 | F02N 11/08 |

OTHER PUBLICATIONS

English translation of Chinese Office Action dated Jul. 26, 2013 (3 pages).

* cited by examiner

*Primary Examiner* — Hai Huynh
(74) *Attorney, Agent, or Firm* — Crowell & Moring LLP

(57) ABSTRACT

There is provided an idle stop system that can more quickly restart with small noise in conducting idle stop. In preparation for a restart request during an engine inertial rotation, after a motor is rotated in a state where a starter motor is not coupled to the engine, a pinion is engaged with a ring gear during the motor is subjected to inertial rotation like the engine. In this situation, the rotational speed including future pulsation of the engine is estimated with the use of information on the crank angle, and a pinion pushing timing is controlled so that the pinion and the ring gear contact each other with a given rotational speed difference taking a delay time of a pinion pushing unit into consideration.

12 Claims, 7 Drawing Sheets

503

ESTIMATED START TIME
CRANK ANGLE

| SPEED DIFFERENCE AT ESTIMATED START TIME | 0 | 10 | 20 | 30 | ··· | 120 |
|---|---|---|---|---|---|---|
| 100 | 133 | 122 | 111 | 101 | | 133 |
| 90 | 136 | 124 | 112 | 102 | ··· | 136 |
| 80 | 140 | 126 | 114 | 102 | | 140 |
| 70 | 142 | 129 | 115 | 103 | | 142 |
| ⋮ | | | ⋮ | | ⋱ | |
| 0 | 0 | 0 | 0 | 0 | | 0 |

TIME Tp [ms] UNTIL SPEED DIFFERENCE BECOMES ΔNref

604

ENGINE ROTATIONAL SPEED AT ESTIMATED START TIME

ESTIMATED START TIME CRANK ANGLE

| | 0 | 10 | 20 | 30 | ··· | 120 |
|---|---|---|---|---|---|---|
| 300 | 330 | 310 | 290 | 270 | | 330 |
| 290 | 321 | 299 | 277 | 258 | ··· | 321 |
| 280 | 312 | 288 | 264 | 246 | | 312 |
| 260 | 303 | 277 | 251 | 234 | | 303 |
| ⋮ | | | ⋮ | | ⋱ | |
| 0 | 0 | 0 | 0 | 0 | | 0 |

ENGINE ROTATIONAL SPEED AFTER Tdelay SECONDS

IDLE STOP CONTROL METHOD AND CONTROL DEVICE

FIELD OF THE INVENTION

The present invention relates to an idle stop system that automatically stops and restarts an engine.

BACKGROUND OF THE INVENTION

In recent years, automobile technologies for the purpose of saving of energy resources and environment protection have been developed. For example, there is an idle stop system in which when a given condition (automatic stop condition) is satisfied during operation, a fuel to be supplied to an engine is cut off to lose a torque generated in an engine. The automatic stop condition is satisfied by lifting a driver's foot off an accelerator, or putting on a brake. In this idle stop system, even if a vehicle does not stop, if the automatic stop condition is satisfied, the engine is automatically stopped. Thereafter, the engine restarts when receiving a restart request from a driver, or when an engine operation is required.

As a method of restarting the engine, a method is applied in which with the use of a pinion pushing starter, a pinion of a starter is pushed to engage the pinion with a ring gear of the engine, rotation of the starter is transmitted to the engine, and the engine is rotated and started.

There has been proposed a method in which then during inertial rotation after the torque generated by the engine is lost, such a condition that the accelerator is pressed is satisfied, and the restart is requested, a motor of the starter starts to be energized to rotate the pinion, the pinion is engaged with the ring gear to start cranking by the starter when the rotational speed of the pinion is synchronized with the rotational speed of the ring gear, thereby hastening restoration of the engine rotation (Japanese Patent No. 4214401). In this Japanese Patent, a motion energy of the engine and the amount of work for preventing the motion of the engine are computed, and a future motion energy is estimated to estimate a future engine rotational speed.

SUMMARY OF THE INVENTION

The pinion pushing starter has a delay time since the pinion is pushed until the pinion arrives at the ring gear, and there is a need to estimate the rotational speed of the engine when the pinion arrives at the ring gear for smoothing engagement. However, since a cylinder in a compression stroke works to consume energy, the rotational speed of the engine is attenuated while being pulsated even during the inertial rotation. Hence, in order to estimate the future engine rotational speed, there is a need to accurately estimate the rotational speed of the engine that is attenuated while being pulsated. At the time of engagement, respective gear tooth knock together to generate noise, and a speed difference of the rotational speed between the pinion and the ring gear at that time largely affects the noise.

The present invention aims at suppression of noise occurring when the ring gear of the engine and a pinion gear of the starter are engaged with each other during the inertial rotation of the engine.

According to an aspect of the present invention, there is provided a so-called pre-mesh idle stop system in which the pinion of the starter is pushed to engage the pinion with the ring gear of the engine, and the engine is started by cranking due to the starter when restart is requested, wherein timing in which the pinion gear and the ring gear are engaged with each other is controlled on the basis of crank angle information.

The rotational speed of the engine which is changed while being pulsated even during the inertial rotation of the engine can be estimated with the use of the crank angle information taking a pulsation component into consideration. As a result, the pinion and the ring gear can contact each other with an arbitrary speed difference, and the pinion gear and the ring gear can be engaged with each other with a given speed difference that enables smooth engagement with small noise.

DETAILED DESCRIPTION OF THE PREFERRED EMBODIMENTS

Embodiments according to the present invention will be described as follows. An idle stop system includes a crank angle detection unit that detects a crank angle of a crank shaft of an engine, a ring gear rotational speed detection unit that detects a rotational speed of a ring gear, and a pinion rotational speed detection unit that detects a rotating speed (hereinafter referred to as "rotational speed of the pinion") obtained by converting the rotational speed of the pinion into the rotational speed of the ring gear that rotates synchronously taking a gear ratio into consideration. With the above configuration, when idle stop is conducted, during an engine inertial rotation period since a torque generated by the engine is lost until the rpm of the engine becomes zero, after the pinion of the starter is rotated, the pinion made in the inertial rotation state is engaged with the ring gear coupled to the crank shaft of the engine. In conducting the engaging operation, taking a delay of the pinion pushing unit into consideration, the future engine rotational speed including pulsation is estimated on the basis of the ring gear rotational speed detection unit and the crank angle detection unit. Also, the pushing timing of the pinion pushing unit is controlled so that the pinion and the ring gear contact each other with a given rotational speed difference on the basis of the pinion rotational speed detection unit, to implement the engaging operation. Thereafter, the engagement of the pinion is maintained during the idle stop, and cranking by the starter starts to restart the engine immediately after the restart is requested.

Hereinafter, embodiments of the present invention will be described in detail with reference to the accompanying drawings.

Figure 2:
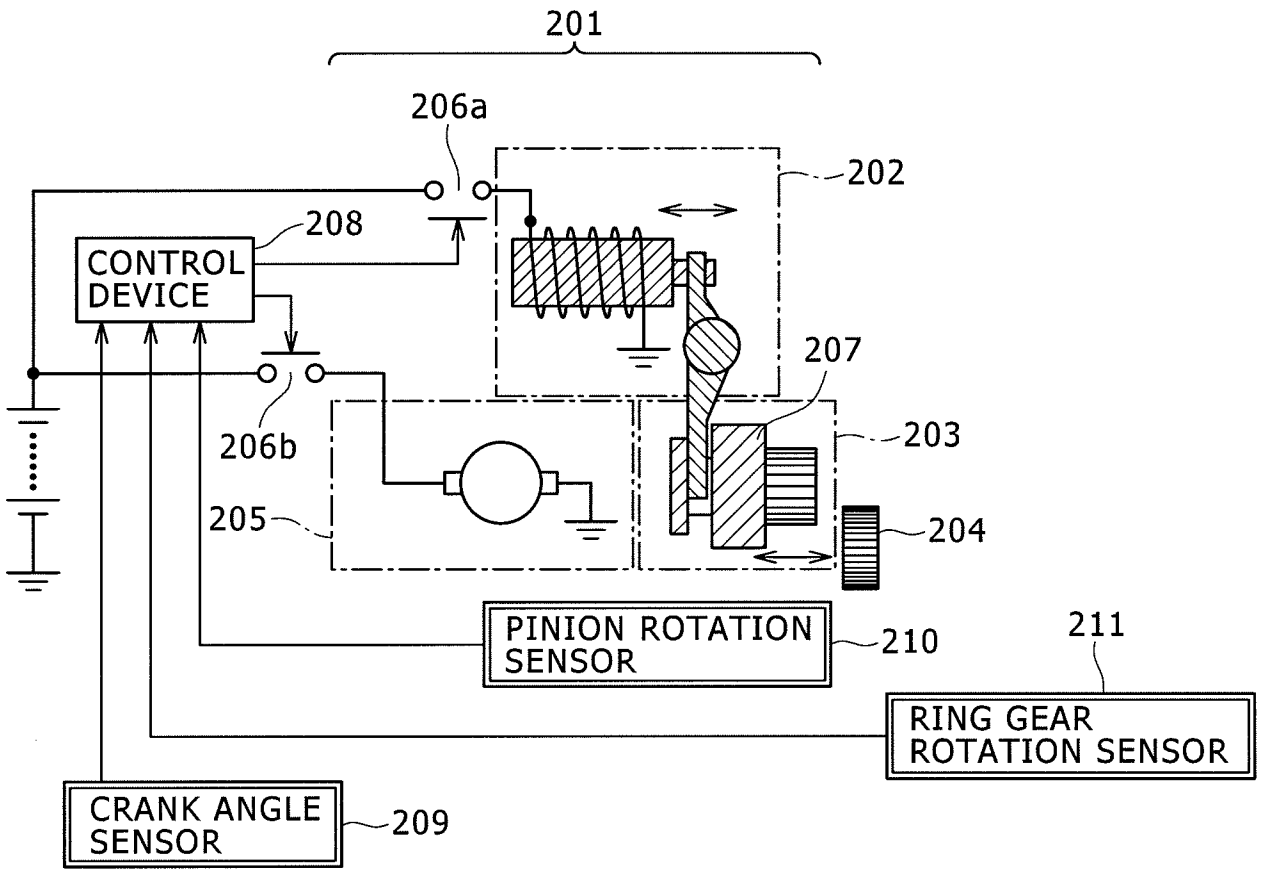
FIG. 2 is a simplified schematic diagram illustrating a structure of an idle system and a circuit connection.

FIG. 2 is a schematic diagram of a simple structure and a circuit connection of a starter 201 and a control device 208 according to this embodiment. The starter 201 is configured by a so-called pinion pushing starter, and includes a starter motor 205, a pinion gear 203 rotationally driven by the starter motor 205, and a magnetic switch 202 for pushing the pinion gear 203. The rotation of the starter motor 205 is reduced by a reduction mechanism disposed therein to increase the torque, and then transmitted to the pinion gear 203. When the magnetic switch 202 is energized, the pinion gear 203 is pushed by the magnetic switch 202 (rightward in FIG. 2) and coupled to a ring gear 204. The magnetic switch 202 may be replaced with another member having a function of pushing the pinion gear 203. The pinion gear 203 is integrated with a one-way clutch 207. The pinion gear 203 can be moved in an axial direction of the starter motor 205. The pinion gear 203 rotates while being engaged with the ring gear 204 coupled to the crank shaft of the engine, thereby enabling a power to be transmitted to the engine. The one-way clutch 207 is configured to transmit the power only in a direction along which the starter motor 205 positively rotates the engine. With this configuration, when the pinion gear 203 is engaged with the ring gear 204, the rotational speed of the ring gear becomes a synchronous speed corresponding to a reduction ratio with respect to the rotational speed of the starter motor 205, or becomes a rotational speed higher than the synchronous speed. That is, when the ring gear 204 is going to be lower than the rotational speed of the pinion gear 203, because the one-way clutch 207 transmits the power to the ring gear 204, the ring gear 204 does not fall below the synchronous speed with respect to the starter motor 205. On the other hand, when the rotational speed of the ring gear is higher than the synchronous speed, because the one-way clutch does not transmit the power, the power is not transmitted from the ring gear 204 to the starter motor 205 side.

As illustrated in FIG. 2, signals from a pinion rotation sensor 210 (pinion rotational speed detection unit), a ring gear rotation sensor 211 (ring gear rotational speed detection unit), and a crank angle sensor 209 (crank angle detection unit) are input to the control device 208. Since the ring gear 204 and the crank shaft of the engine are coupled to each other, the ring gear rotational speed and the engine rotational speed are synonymous. The control device 208 permits idle stop according to various information such as a brake pedal state and a vehicle speed in addition to a normal fuel injection, ignition, and air control (electronic control throttle), and conducts fuel cut-off. A pinion pushing instruction signal and a motor rotation instruction signal are output from the control device, independently. As illustrated in FIG. 2, a magnet switch energization switch 206*a* for transmission of the pinion pushing instruction signal and a starter motor energization switch 206*b* for transmission of the motor rotation instruction signal control the pinion pushing and the rotation of the starter motor 205. Parts serving as the switch can include a relay switch having a mechanical contact, and a switch using semiconductor.

Figure 1:
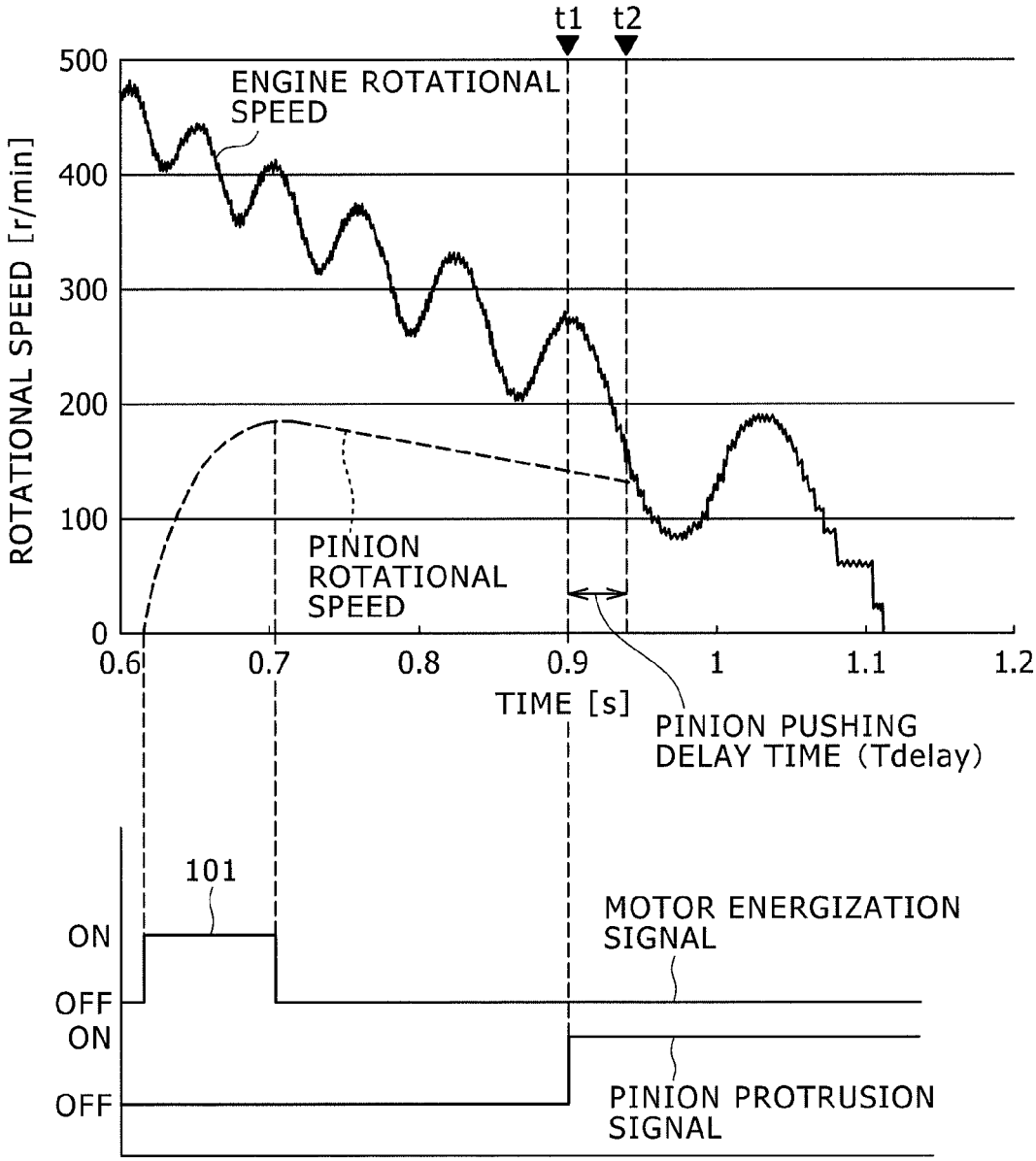
FIG. 1 illustrates an example of behaviors of an engine rotational speed and a pinion rotational speed and an output of a control device when the present invention is implemented.
Figure 3:
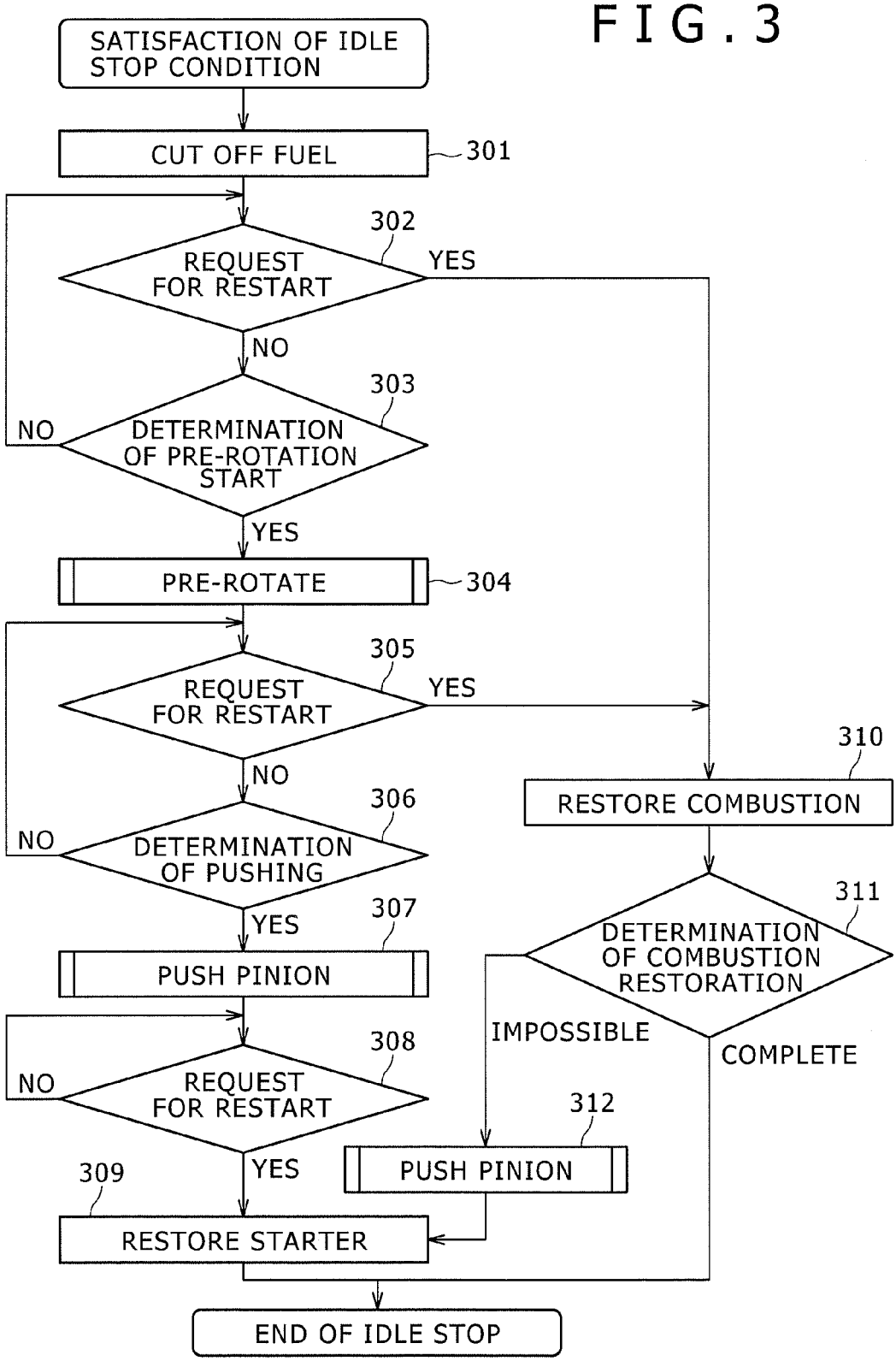
FIG. 3 is a flowchart illustrating an embodiment.

FIG. 3 is a control flowchart for implementing the idle stop system of the present invention, which is implemented within the control device 208. Also, FIG. 1 illustrates an example of changes in the rotational speeds of the ring gear 204 and the pinion gear 203 with time, and output signals of the control device 208. As illustrated in FIG. 3, first in response to a fact that the idle stop condition is satisfied, fuel injection is stopped in Step 301. As a result, the engine rotation starts inertial rotation. Then, the starter motor 205 is energized as indicated by reference numeral 101 of FIG. 1. The rotation caused by this energization is called "pre-rotation". When the starter motor 205 is pre-rotated, the pinion gear 203 is pre-rotated. Determination for starting the pre-rotation is conducted in Step 303. It is conceivable that the determination for starting the pre-rotation is conducted under a condition where the engine rotational speed falls below a given rotational speed. After the pre-rotation start determination is performed, the starter motor 205 is energized in Step 304 to start the pre-rotation. When the pre-rotation is conducted, for example, for a given time, or the rotational speed of the pinion gear 203 arrives at a given rotational speed, the pre-rotation is completed. Thereafter, energization stops to lose a torque generated by the starter motor 205, and the pinion gear 203 shifts to inertial rotation. In this embodiment, it is not always necessary to pre-rotate the starter motor. The present invention can be applied to a case in which the starter motor does not rotate. With the pre-rotation, the pinion gear 203 and the ring gear 204 can be smoothly engaged with each other even if the engine rotational speed, that is, the rotational speed of the ring gear 204 is in a relatively high region. After the pre-rotation of the starter motor 205, the pinion pushing determination is performed in Step 306, and a pushing instruction is issued in a timing t1 of FIG. 1. In conducting the determination, the rotational speed of the ring gear 204 and the rotational speed of the pinion gear 203 at a time (that is, t2 in FIG. 1) when the pinion gear 203 is pushed by the determination, and the pinion gear 203 contacts the ring gear 204 are estimated. Then, the pushing timing is determined so that a rotational speed difference therebetween becomes a given value to conduct the determination. That is, a delay time (Tdelay) of the pinion pushing unit is from the timing t1 to the timing t2 in FIG. 1, and taking this delay time into consideration, the pushing instruction (t1 in FIG. 1) is issued in advance. That is, the changes in the rotational speed of the pinion gear 203 and in the rotational speed of the ring gear 204 in the delay time of the pinion pushing unit, that is, in a time since the pinion moves until the pinion arrives at the ring gear are estimated. With this estimation, a protruding timing can be determined so that a speed difference between the pinion gear 203 and the ring gear 204 at the time when the pinion gear 203 contacts the ring gear 204 becomes an optimum speed difference, and the smooth engagement can be realized with small noise. The future rotational speed of the ring gear 204 is momentarily estimated by the control device. That is, the future rotational speed of the ring gear 204 is estimated with the use of the momentary information on the engine rotational speed and the crank angle. In the following description, a time when the future rotational speed of the ring gear 204 is momentarily estimated is called "estimation start time". An embodiment for the pinion pushing determination will be described in detail later.

In response to a restart request issued after the pinion gear 203 is engaged with the ring gear 204, restart operation starts by the starter immediately in Step 309. Since the pinion gear 203 has been engaged with the ring gear 204, quick restart operation is enabled by energizing the starter motor 205 immediately and starting cranking. On the other hand, there is a possibility that the restart request is issued since the idle stop starts until the pinion gear 203 is engaged with the ring gear 204. On the contrary, the determination is performed in Steps 302 and 305, fuel injection is restarted in Step 310, and restart is attempted by combustion. Even after the idle stop condition is satisfied, and fuel is cut off, the engine rotation can be restored by restarting the fuel injection and restarting combustion while the engine rotation is high. However, while the engine rotation is low, even if combustion is restarted, the engine may stop as it is. It is determined whether the engine can be subjected to combustion restoration, or not, in Step 311, and only when the combustion restoration cannot be conducted, the pinion gear 203 is engaged with the ring gear 204 in Step 312 to conduct restart by the starter 201. In the combustion restoration determination, for example, it can be determined that the combustion restoration cannot be conducted, at a time when the engine rotational speed falls below a given value (for example, 50 r/min). Also, it can be determined that the combustion restoration is completed at a time when the engine rotational speed exceeds a given value (for example, 500 r/min).

Figure 4:
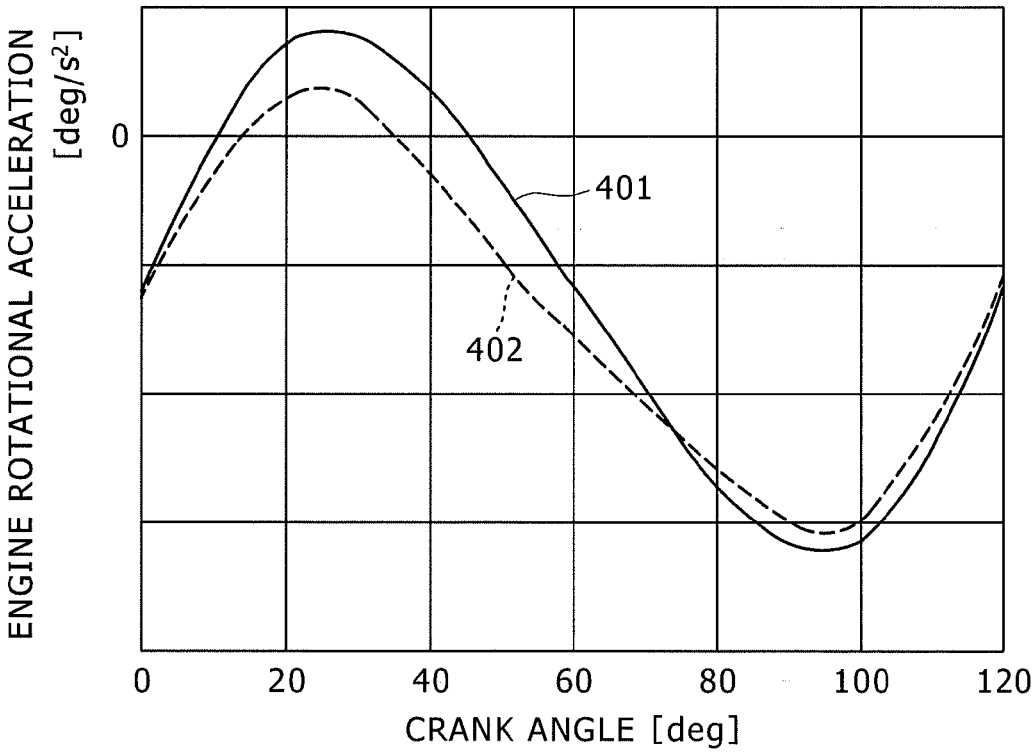
FIG. 4 illustrates an example of a fitting function representing a relationship between acceleration of an engine rotational speed and a crank angle during inertial rotation.

Subsequently, a method of estimating the future rotational speed of the ring gear 204 will be described. The present inventors have found through research that there is no behavior that the engine rotational speed during the inertial rotation is decreased at a given change ratio, but the rotational speed is decreased while the change ratio (rotational acceleration) of the engine rotational speed is periodically changed in correspondence with the crank angle. In this embodiment, the future engine rotational speed, that is, the rotational speed of the ring gear 204 is estimated with the use of the change ratio of the engine rotational speed which is periodically changed. First, a fitting function approximately associated with a relationship between the crank angle and the acceleration of the engine rotational speed is created in advance. In creation of the fitting function, the behavior of the real engine rotational speed during the inertial rotation and the crank angle information at that time are first acquired, and the change ratio (=rotational acceleration) of the engine rotational speed is obtained from the continuous engine rotational speed. Assuming that the change ratio of the engine rotational speed is periodically changed in correspondence with the crank angle, and almost uniquely determined by the crank angle, the fitting function that approximately obtains the change ratio of the engine rotational speed with the crank angle a parameter is determined. The fitting function is determined by combination of, for example, polynomials or trigonometric functions so that the fitting function overlaps with the real change ratio of the engine rotational speed. A graph 401 in FIG. 4 represents an example of the fitting function showing a relationship between the crank angle and the acceleration of the engine rotational speed during the inertial rotation of the engine. This is an example of a six-cylinder engine, and the crank angle is set to 0 degrees when a cylinder of a compression stroke reaches a top dead center. In a four-cylinder engine, one cycle is two rotations of the crank shaft. Therefore, in the six-cylinder engine, another cylinder has the same phase every time the crank shaft rotates 120 degrees. For that reason, the rotational speed of the engine is periodically increased or decreased every time the crank shaft rotates 120 degrees. Hence, the fitting function starts from 0 degrees (top dead center), and ends at 120 degrees. In the four-cylinder engine, since the rotational speed of the engine is periodically increased or decreased every time the crank shaft rotates 180 degrees, the fitting function ends at 180 degrees. In the engine rotation behavior during the inertial rotation, the change ratio (=acceleration) of the engine rotational speed can be obtained periodically referring to the fitting function. In this example, the engine rotation acceleration is uniformly determined with respect to the crank angle. However, not only the crank angle but also an element such as the engine rotational speed can be included in the parameter of the fitting function. When the future engine rotational speed is estimated, the fitting function representative of the engine rotation acceleration is analytically or numerically integrated in time with the engine rotational speed and the crank angle at the time of starting estimation as initial conditions. As a result, the engine rotational speed at an arbitrary future time during the inertial rotation can be estimated. For example, when the fitting function is numerically integrated in time, integration can be conducted as follows. The acceleration is calculated with the use of the fitting function on the basis of the crank angle information of an initial condition, and multiplied by acceleration. As a result, the amount of change in the engine rotational speed after a fine time can be obtained, and the amount of change is added to the engine rotational speed of the initial condition whereby the engine rotational speed after the fine time can be obtained. Also, the engine rotational speed of the initial condition is multiplied by the fine time so that the amount of change of the crank angle after the fine time can be obtained, and the amount of change is added to the crank angle of the initial condition so that the crank angle after the fine time can be obtained. The engine rotational speed and the crank angle after the fine time are continuously calculated to estimate the engine rotational speed at the arbitrary future time.

The behavior of the engine rotation during the inertial rotation may be changed according to an engine state such as temperature, load, or total running time, and it is conceivable that an individual difference occurs in mass production. The provision of only a fitting function 401 created in advance as shown in FIG. 4 is insufficient to deal with a change in the engine state, and the estimated future engine rotational speed may be deviated from the real engine rotational speed. On the contrary, in estimating the future engine rotational speed with the use of the acceleration of the engine rotational speed, the acceleration of the past real engine rotation speedup to the estimated start time is measured, and a correspondence relationship between the acceleration and the crank angle can always be updated and used for estimation of the future engine rotational speed. In updating the correspondence relationship between the acceleration and the crank angle, for example, the change ratio of the engine rotational speed is calculated according to the engine behavior when the engine is finally stopped or immediately before the estimated start time, and stored within the control device in association with the crank angle. An example of the updated fitting function representative of the correspondence relationship between the acceleration and the crank angle is indicated by reference numeral 402 of FIG. 4. The updated fitting function is stored within the control device even if a power supply of the control device turns off, and also may be updated in association with information such as temperature. The information on the change ratio of the engine rotational speed and the crank angle is held within the control device, and the correspondence relationship is always updated and used for estimation of the future engine rotational speed. This can flexibly deal with the change in the engine rotational speed to enable more accurate estimation.

Figure 5:
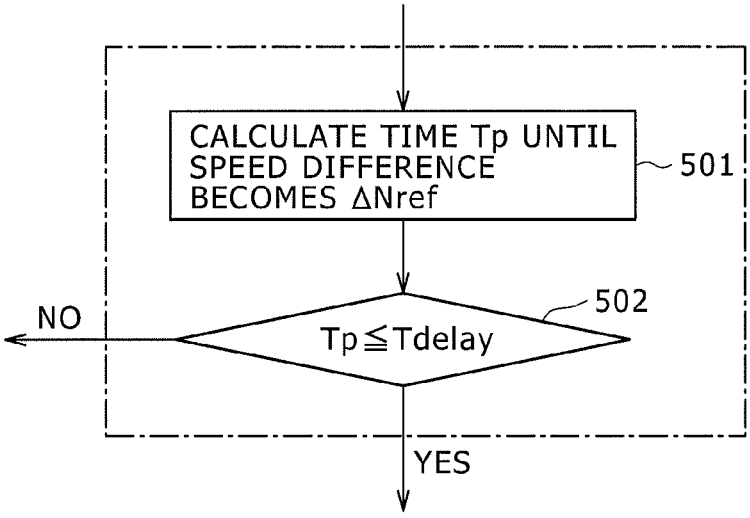
FIG. 5 illustrates an example of a flowchart and a table used in calculation of a pinion pushing determination according to a first embodiment.
Figure 6:
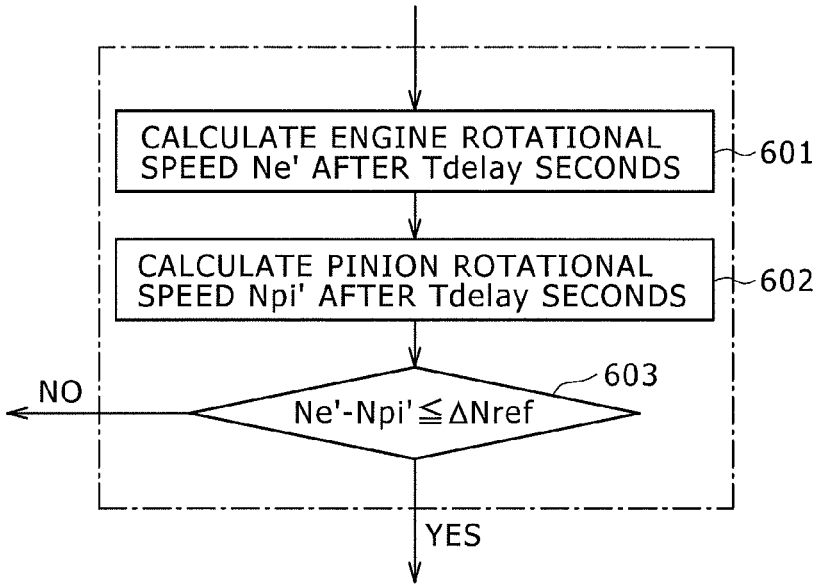
FIG. 6 illustrates an example of a flowchart and a table used in calculation of a pinion pushing determination according to a second embodiment.

With the use of the method for estimating the engine rotational speed, the engine rotational speed at an arbitrary future time can be estimated. Also, since it is conceivable that the pinion rotational speed during the inertial rotation is decreased at a constant deceleration, the future pinion rotational speed can be estimated with a linear relationship. Hence, with combination of those estimations, a future rotational speed difference between can be estimated. In Step 306 of FIG. 3, the pinion protrusion determination is performed on the basis of the estimated ring gear rotational speed and pinion rotational speed after a given time (Tdelay) has been elapsed. FIGS. 5 and 6 illustrate two more specific embodiments of the pinion protrusion determination in Step 306 of FIG. 3. In the pinion protrusion determination, the pinion gear 203 contacts the ring gear 204 at the time (t2 in FIG. 1) when the rotational speed difference between the future engine rotational speed and the pinion gear 203 rotational speed becomes a given value.

In a method shown in FIG. 5, with the use of the engine rpm estimating method in Step 501, a time (Tp) until the speed difference between the rotational speed of the ring gear 204 and the rotational speed of the pinion gear 203 becomes a given value (ΔNref) is calculated. A protrusion instruction is issued when a time until the speed difference becomes the given value is equal to or lower than a delay time (Tdelay) of the pinion protrusion in Step 502. When this method is implemented by the control device 208, the time until the rotational speed difference becomes the given value (ΔNref) is provided in a table having the rotational speed and the crank angle at the estimated start time as items, and the time can be calculated with reference to the table. This table is created on the basis of the future engine rotational speed estimating method in advance. A reference numeral 503 in FIG. 5 shows an example of a table. In this example, the speed difference between the ring gear and the pinion at the estimated start time is represented by a vertical item, and the crank angle at the estimated start point is represented by a lateral item. With the use of information at the estimated start point, a remaining time till a time at which the pinion and the ring gear should contact each other (time when the speed difference becomes ΔNref) can be obtained with reference to the table. The obtained remaining time is compared with the delay time (Tdelay) of the pinion protrusion, and the pinion protrusion instruction is issued when the remaining time becomes equal to or lower than the delay time of the pinion. Also, the multiple tables are prepared in advance, and the table referred to is changed according to a position of a shift lever, and a temperature or a load of the engine so as to flexibly deal with a change in the engine state.

In the method illustrated in FIG. 6, with the use of the method for estimating the engine rotational speed in Step 601, an engine rotational speed Ne' after Tdelay seconds is estimated, and a pinion rotational speed Npi' after Tdelay seconds is estimated in Step 602. Then, when the rotational speed difference therebetween after Tdelay seconds becomes equal or lower than the given value (ΔNref) in Step 603, the pinion protrusion instruction is issued. When this method is implemented by the control device 208, the future engine rotational speed is provided in a table having the engine rotational speed at the estimated start time and the crank angle at the estimated start time as items, and the future engine rotational speed can be calculated with reference to the table. This table is created on the basis of the future engine rotational speed estimating method in advance. A reference numeral 604 in FIG. 6 shows an example of a table. In this example, the engine rotational speed at the estimated start time is represented by a vertical item, and the crank angle at the estimated start point is represented by a lateral item. With the use of information at the estimated start point, the engine rotational speed after Tdelay seconds can be obtained with reference to the table. It is assumed that the rotational speed of the pinion during the inertial rotation is decreased at a given slope with time, whereby the pinion rotational speed after Tdelay seconds can be estimated. The pinion protrusion instruction is issued when the speed difference therebetween after Tdelay becomes equal to or lower than ΔNref. As a result, when the real speed difference therebetween after Tdelay seconds is ΔNref, the pinion gear 203 contacts the ring gear 204, and engagement of the pinion gear 203 with the ring gear 204 is realized. Also, the multiple tables are prepared in advance, and the table referred to is changed according to a position of a shift lever, and a temperature or a load of the engine so as to flexibly deal with a change in the engine state. The protrusion determinations of the pinion gear 203 which are conducted by the method illustrated in FIG. 5 and the method illustrated in FIG. 6 are identical in principle with each other except for a difference in the calculation procedure.

Figure 7:
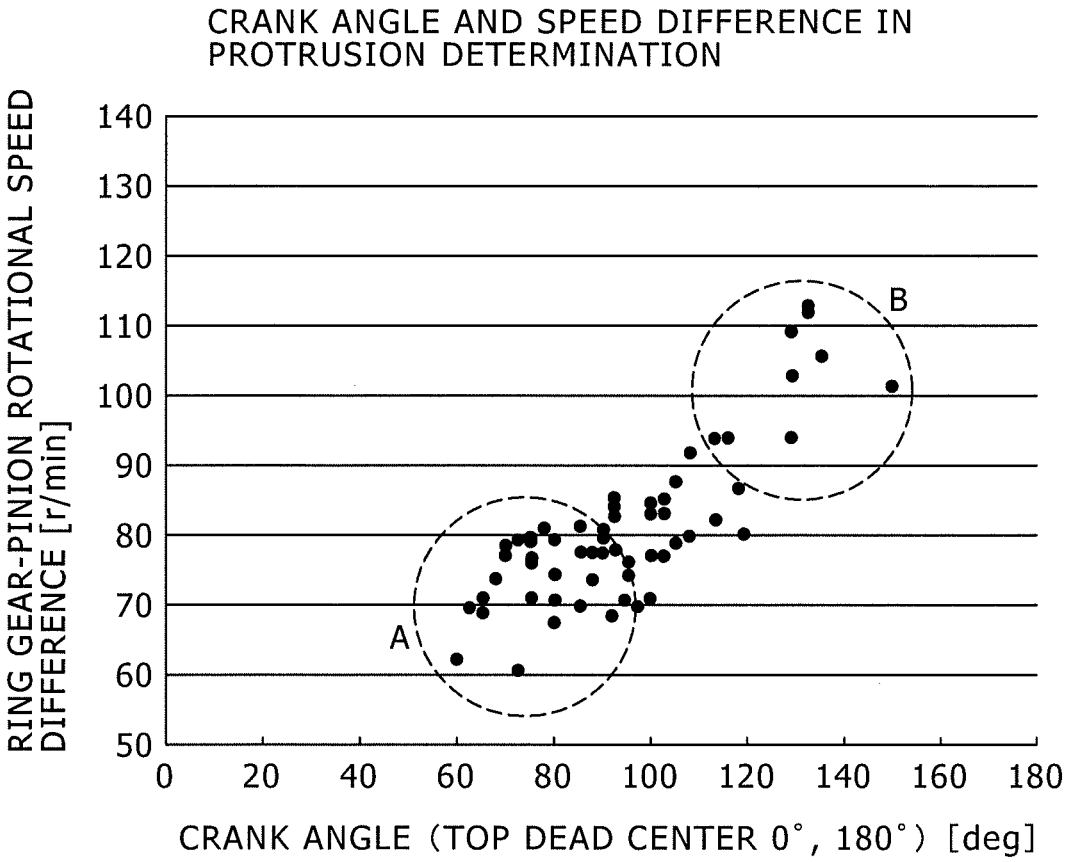
FIG. 7 is a graph showing a crank angle and a speed difference at the moment when a pinion pushing signal is output.

With the application of this embodiment, the engagement of the starter 201 with the pinion gear 203 is maintained during the idle stop after the pinion is engaged with the ring gear that is in the inertial rotating state, and prepares for the restart request. When the pinion gear 203 is protruded, the speed difference between the rotational speed of the ring gear 204 and the rotational speed of the pinion gear 203 at a moment (t1) when the pinion protrusion signal is output is changed in correspondence with the crank angle at that moment. That is, since the protrusion timing of the pinion gear 203 is determined with the use of the crank angle information, when the speed difference and the crank angle at the moment when the pinion protrusion signal is output are extracted, this embodiment shows a tendency that the crank angle corresponds to the speed difference. FIG. 7 graphs the crank angle and the speed difference at the moment when the pinion protrusion signal is output when the present invention is really implemented in multiple times with the use of the four-cylinder engine. In this example, the rotational speed of the pinion and the ring gear at the time (t2) when the pinion arrives at the ring gear falls within 0 to 30 [r/min]. In an example of FIG. 7, it is found that, in an area of A, when the crank angle is about 60°, the speed difference between the ring gear and the pinion as soon as the pinion protrusion signal is output is relatively small, and in an area of B, when the crank angle becomes about 140°, the speed difference is large. This is because it is estimated that the engine rotational speed is quickly decreased before the top dead center when the crank angle is about 140°, and it is assumed that even if the speed difference therebetween is relatively large, the speed difference becomes a set value when the pinion contacts the ring gear, and the pinion protrusion determination is performed. In the area of A, since it is estimated that the engine rotational speed is relatively slowly decreased, the protrusion determination is performed when the speed difference therebetween is small. In this way, when the present invention is implemented, in order that the speed difference therebetween when the pinion contacts the ring gear falls within a given range, the speed difference therebetween and the crank angle as soon as the pinion protrusion determination is performed, and the protrusion signal is output are extracted. As a result, there is a tendency that the protrusion determination is performed even if the speed difference between the ring gear and the pinion is large in the vicinity of the crank angle where it is estimated that the engine rotational speed is largely decreased, and the protrusion determination is performed when the speed difference therebetween is small in the vicinity of the crank angle where the engine rotation is relatively small, and decreased. The example of FIG. 7 shows a tendency that the speed difference between the ring gear and the pinion is simply increased and linear in correspondence with the crank angle, and is not simply increased depending on the engine behavior. Also, in this example, the protrusion determination is performed only when the crank angle is between about 60° and about 150°. However, according to the present invention, depending on the engine behavior, the protrusion determination is performed without limiting the range of the crank angle, and the above tendency is exhibited.

The present inventors have found through research that noise occurring when the pinion gear 203 contacts the ring gear 204 is largely changed according to the speed difference when the pinion gear 203 and the ring gear 204 contact each other. If the speed difference is large, the pinion gear 203 and the ring gear 204 are synchronized with each other, and it takes time to insert the pinion, and also noise is large. On the other hand, it is not always sufficient to set the speed difference to 0, and when the pinion contacts with ring gear in a state where the rotational speed of the ring gear is slightly higher, the engagement is more smoothly completed, and noise is also relatively small. This is because if the ring gear contacts the pinion when the ring gear rotational speed is higher than the pinion rotational speed, the one-way clutch is disconnected, and if only the pinion is synchronized with the ring gear, since the engagement is conducted, the engagement is smoothed, and on the other hand, the one-way clutch is connected, and impact for synchronizing the motor becomes large. According to this embodiment, since the speed difference when the pinion and the ring gear contact each other can be set to an arbitrary speed difference, if the speed difference is set so that the noise becomes small, noise depending on the speed difference can be suppressed.

What is claimed is:

1. A control device for an idle stop system of a type in which fuel injection is stopped when an idle stop condition is satisfied during engine operation, and a pinion gear is engaged with a ring gear coupled to a crank shaft of an engine during an engine inertial rotation period until an engine rpm becomes zero, wherein the idle stop system includes:

a ring gear rotational speed detection unit that detects a rotational speed of the ring gear;

a crank angle detection unit that detects a crank angle of a crank shaft of the engine; and a pinion rotational speed detection unit that detects a rotating speed of the pinion, and wherein the control device estimates a future engine rotational speed on the basis of the ring gear rotational speed detection unit and the crank angle detection unit, and controls a pushing timing of a pinion pushing unit taking a delay of the pinion pushing unit into consideration so that the pinion contacts the ring gear when there is a given speed difference between a pinion rotational speed obtained by converting the pinion rotational speed based on the pinion rotational speed detection unit taking a reduction ratio of the pinion to the ring gear into consideration, and the rotational speed of the ring gear.

2. The control device for an idle stop system according to claim 1, wherein the control device calculates a time from a present time till a time when a difference between the ring gear rotational speed and the pinion rotational speed becomes the given speed difference, and controls the pushing start timing of the pinion pushing unit so that the pinion contacts the ring gear at a time when the difference becomes the given rotational speed difference taking a delay time of the pinion pushing unit into consideration.

3. The control device for an idle stop system according to claim 2, wherein when calculating the time from the present time till the time when the difference between the ring gear rotational speed and the pinion rotational speed becomes the given speed difference, the control device creates a table including the difference between the engine rotational speed and the pinion rotational speed at the present time, and a crank angle as items in advance, and calculates the time referring to the table.

4. The control device for an idle stop system according to claim 3, wherein a plurality of the tables are provided in correspondence with a change in the engine state, and the table referred to is changed to deal with a change in the condition.

5. The control device for an idle stop system according to claim 2, wherein the control device measures an acceleration of the engine rotational speed associated with the crank angle during the engine inertial rotation period, and an acceleration of the engine rotational speed corresponding to the crank angle before an estimation start time, and applies the measured acceleration to estimation of a future engine rotational speed.

6. The control device for an idle stop system according to claim 1, wherein the control device estimates the ring gear rotational speed and the pinion rotational speed after a given time, and starts the pinion pushing by using the pinion pushing unit when a speed difference between the estimated ring gear rotational speed and pinion rotational speed falls below the given rotational speed difference.

7. The control device for an idle stop system according to claim 6, wherein when calculating the ring gear rotational speed after a given time is elapsed from the present time, the control device creates a table including the engine rotational speed at the present time, and a crank angle as items in advance, and calculates the ring gear rotational speed after the given time is elapsed referring to the table.

8. The control device for an idle stop system according to claim 7, wherein a plurality of the tables are provided in correspondence with a change in the engine state, and the table referred to is changed to deal with a change in the condition.

9. The control device for an idle stop system according to claim 1, wherein the speed difference between the pinion rotational speed and the rotational speed of the ring gear when the pinion contacts the ring gear is set to a rotational speed difference where noise when the pinion contacts the ring gear is minimum.

10. The control device for an idle stop system according to claim 1, wherein the speed difference between the pinion rotational speed and the rotational speed of the ring gear when the pinion contacts the ring gear is set to a rotational speed difference where the ring gear rotational speed is higher than the pinion rotational speed.

11. The control device for an idle stop system according to claim 1, wherein when a restart is requested before the pinion is engaged with the ring gear during the engine inertial rotation period until the engine is completely stopped, fuel is again fed to the engine to attempt restart.

12. A control method for an idle stop system of a type in which fuel injection is stopped when an idle stop condition is satisfied during engine operation, and a pinion gear is engaged with a ring gear coupled to a crank shaft of an engine during an engine inertial rotation period until an engine rpm becomes zero, the idle stop system including:

a ring gear rotational speed detection unit that detects a rotational speed of the ring gear;

a crank angle detection unit that detects a crank angle of a crank shaft of the engine; and a pinion rotational speed detection unit that detects a rotating speed of the pinion, and the control method comprising:

estimating a future engine rotational speed on the basis of the ring gear rotational speed detection unit and the crank angle detection unit; and controlling a pushing timing of a pinion pushing unit taking a delay of the pinion pushing unit into consideration so that the pinion contacts the ring gear when there is a given speed difference between a pinion rotational speed obtained by converting the pinion rotational speed based on the pinion rotational speed detection unit taking a reduction ratio of the pinion to the ring gear into consideration, and the rotational speed of the ring gear.

* * * * *